United States Patent [19]

Chatterji

[11] 4,162,226

[45] Jul. 24, 1979

[54] ELECTROSTATIC TONER WITH AN ANTIPLASTICIZER

[76] Inventor: Arun K. Chatterji, 100 Kittelberger Park, Webster, N.Y. 14580

[21] Appl. No.: 443,689

[22] Filed: Feb. 19, 1974

Related U.S. Application Data

[62] Division of Ser. No. 259,953, Jun. 5, 1972, Pat. No. 3,792,964.

[51] Int. Cl.[2] ..... G03G 9/08

[52] U.S. Cl. ..... 252/62.1 P; 427/20; 96/15 D

[58] Field of Search ..... 252/62.1; 96/1 SD; 427/20

[56] References Cited

U.S. PATENT DOCUMENTS

| | | | |
|---|---|---|---|
| 3,556,998 | 1/1971 | Steiner | 252/62.1 |
| 3,609,082 | 9/1971 | Moriconi | 252/62.1 |
| 3,752,666 | 8/1973 | Hagenbach et al. | 252/62.1 |
| 3,850,663 | 11/1974 | Hagenbach | 252/62.1 |
| 3,857,792 | 12/1974 | Madrid | 252/62.1 |
| 3,933,665 | 1/1976 | Van Engeland | 96/1 SD |

*Primary Examiner*—Roland E. Martin, Jr.
*Assistant Examiner*—John L. Goodrow
*Attorney, Agent, or Firm*—Shlesinger, Fitzsimmons & Shlesinger

[57] ABSTRACT

A copying machine having means for producing a fusible toner image on a copy substrate, includes a radiant energy light source (e.g. iodine quartz lamp) mounted to direct part of its rays onto the object that is to be copied to illuminate the latter, and part onto the surface of a rotating receiver roll to heat the surface thereof approximately to the fusing temperature of the toner. The copy substrate is passed beneath the receiver roll tangentially thereof by a transport which causes the toner image to engage the heated receiver surface with a minimal amount of pressure so that the toner is fused and fixed to the substrate. Various release agents may be applied to the roll surface to enhance fixing of the image; and various additives to the toner and/or the developer containing the toner, or to the substrate, may also be used to improve image transfer, image fixing, etc. Novel toners, carriers and photo-conductors for use in this copying process are also disclosed.

4 Claims, 3 Drawing Figures

ELECTROSTATIC TONER WITH AN ANTIPLASTICIZER

Figure 1:
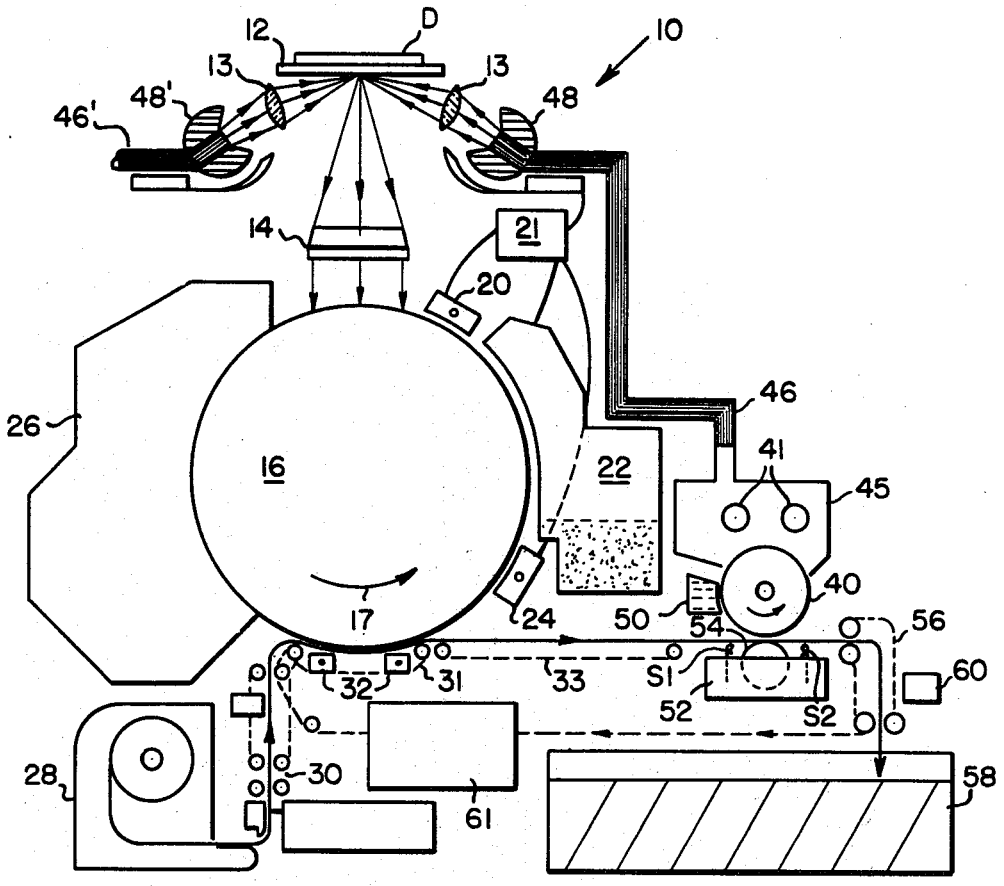

This is a division of application Ser. No. 259,953, filed June 5, 1972, now U.S. Pat. No. 3,792,964.

This invention relates to an electrostatic imaging system, and more particularly to improved process and apparatus for fixing the toner image developed by electrostatic copy processes and the like. Even more particularly this invention relates to the use of improved toners and developers for imaging systems of the type described.

Many known copying systems such as for example, electrophotography, adherography, chemical copying including encapsulated imaging systems, etc. involve the basic steps of producing a latent image on a light sensitive surface or the like; developing a corresponding visible image on a reusable photoconductor or a copy substrate (paper, etc.) by using, for example, a developer containing a toner of either electroscopic or non-electrical attributes, for forming the final visible image on the copy substrate; and then fixing the toner image on the substrate. The step of producing latent images in systems of the type described, generally dictates that the associated machine or apparatus contain a light source and lens system for focusing an image of the matter that is to be copied onto the surface that is to develop the corresponding latent image. The subsequent developing, transferring and fixing steps for the visible image may be performed either as a batch or continuous operation.

Heretofore the fixing step has been achieved in different ways, for example through the use of solvent, vapor, heat, pressure, or combinations thereof, depending, in most cases, on the type of developer employed. The disadvantage of machines employing solvent and/or vapors for fixing purposes is that the air in the vicinity of the machine very often becomes polluted by excess or unused vapors developed by the machine; and if these vapors are inflammable, the threat of fire is increased unnecessarily. For these and other reasons it is now preferable, generally speaking, to use systems which rely upon heat, or a combination of heat and pressure, to fuse or fix a toner image.

The use of heat alone has been employed in various non-contact fusing systems in which the heat source remains spaced from, and does not actually contact the toner at the time that it fixes or fuses the toner to the substrate. Generally this method relies upon convection currents of air (sometimes forced) to transfer heat from a source thereof across the space separating the heat source from the toner image. Due to unavoidable loss of heat during this convective heat transfer operation, the total power requirement of the machine, as represented by the quantity of heat developed at the heat source, is substantially higher than the quantity of heat actually used to fix the image. A further disadvantage has been the difficulty in achieving consistently reliable coalescence of the toner particles in the image. One reason for this is that although the coalescence is effected by the properties of the toner itself, as well as the surface to which it is to be fixed, perhaps the most important factor is the thermal flux, or consistency of heat transfer between the heat source and the toner image. In this non-contact method, however, the existence of the air layer between the heat source and the image makes it extremely difficult efficiently to control this thermal flux, and consequently also makes it difficult to control proper coalescence of the toner particles.

Another heat fusing method of the non-contact variety heretofore employed has involved the use of a radiant energy source to fix a toner image by radiant heat, rather than through a convective heat transfer operation. Prior such radiant heat transfer operations, however, have not been satisfactory since they have also resulted generally in much higher power requirements than needed to produce the heat actually employed to fix an image, and have also had the problem of inefficient or faulty toner coalescence.

It is known that coalescence of toner particles in a heat fixing process can be improved by application of pressure to the heated toner image, which also enables the temperature of the process to be reduced, as compared to the non-contact, heat-only method. However, what has been overlooked heretofore is that the glass transition temperature of a polymer, which is a basic component of typical electrostatic process toner, is increased by the application of pressure. Thus fixing systems employing both heat and pressure are little more efficient than the heat-only systems, since any power saved through reduction in the fixing temperature ambient is exhausted in generating the necessary pressure required by the operation. Moreover, with such systems undesirable change in texture of the image bearing substrate also results from the application of too much pressure.

If an effort to increase the rate of image fixing or toner coalescence without increasing the power input, it has been customary heretofore also to employ special or low melting toners. This, however, often results in undesirable offsetting and consequent blurring of the image. Also, undesirable caking or blocking of toner in the dispenser units or toner containers during transport from one place to another is apt to occur. Further contributing to the high power input per copy, or fixed image output, in prior such devices has been the necessity heretofore to employ, particularly in the case of images fixed by a heat fusing operation, one light source for supplying the illumination necessary for the development stage of the latent image, and a separate light or heat source for use in the toner image fusing or fixing stage of the system.

It is an object of this invention to provide an improved copying process in which a toner image is developed and fused on a copy substrate more rapidly and with less power consumption than heretofore was possible.

Another object of this invention is to provide novel copying apparatus that employs a single energy source for providing both the light for developing the latent image, and energy for the toner image fixing stage of the apparatus.

A further object of this invention is to provide improved copying apparatus of the type described that operates more rapidly and with less power consumption per copy than prior such apparatus.

Still another object of this invention is to provide a novel method of employing radiant energy for fixing a toner image on a copy substrate or the like.

An additional object of this invention is to provide an improved developer for use in a novel copying process of the type described.

A further object of this invention is to provide novel toners and carriers for use in developers of the type employed in copying processes of the type described.

Still another object of this invention is to provide an improved copying system in which the image fixing rate can be selected for low, moderate and high speed operation to integrate the fixing stage of the process with copy subsystem such as, for example, duplicators, on-line printers, etc.

It is an object also of this invention to provide a novel photoconductor for use in copying systems of the type described.

A still further object of this invention is to provide a novel process for producing, for use in developers of the type described, novel carrier particles having variable density and high abrasion and/or temperature-resistant properties.

Other objects of the invention will be apparent hereinafter from the specification and from the recital of the appended claims, particularly when read in conjunction with the accompanying drawing.

Figure 2:
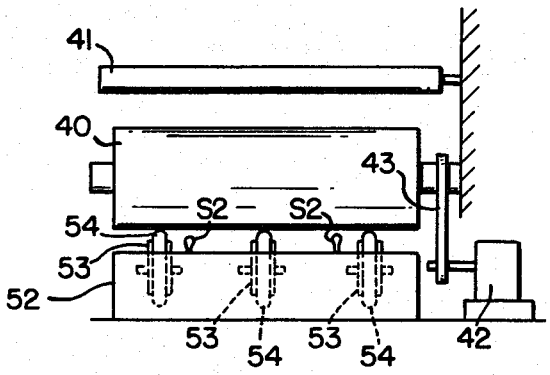
Figure 3:
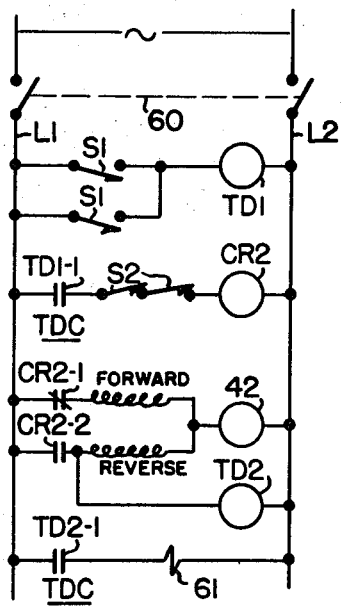

In the drawing:

FIG. 1 is a schematic side elevation view of a machine made in accordance with one embodiment of this invention for practicing the electrostatic imaging process disclosed herein;

FIG. 2 is an enlarged fragmentary elevational view taken at right angles to the view in FIG. 1, illustrating fragmentarily and schematically the discharge sides of the receiver roll and associated transport mechanism which form part of the image fixing system in this machine; and FIG. 3 is a wiring diagram illustrating one manner in which the paper jam control circuit in the machine may be wired for operation.

Referring now to the drawing by numerals of reference, 10 denotes generally a copying machine of the electrostatic variety comprising a document supporting platen 12, which may be made in known manner, from non-glare glass, or the like. Mounted beneath platen 12 are one or more collimating lenses 13 for directing light through the platen 12 to the document thereon as noted thereafter. A copy lens 14, which is mounted beneath the platen 12, is used to direct an image of the document onto the periphery of a photoreceptor drum 16, which is mounted to rotate beneath lens 14 in the direction indicated by arrow 17, and which is coated in the usual manner around its periphery with a light-sensitive photoconductor such as, for example, selenium or an alloy thereof.

Mounted adjacent drum 16 and the portion of its periphery that registers with lens 14 is a conventional charging corona unit 20, which may be controlled by logic circuitry (not illustrated) contained in a nearby unit 21. Mounted adjacent drum 16 in advance of the corona unit 20 is the usual cleaning sybsystem 22; and adjacent this is the usual cleaning corona 24. Units 22 and 24 can also be controlled by circuitry in logic unit 21.

Mounted adjacent drum 16 at its side remote from units 20, 22 and 24 to apply developer to the drum face after the latent document image has been produced thereon, is the development subsystem 26. This system operates in known manner to apply an electroscopic developer, which comprises carrier particles and toner particles, to the latent image on drum 16. The toner image thus formed is then transported by drum 16 over a paper substrate, which is fed from a paper supply 28 by conventional paper transports 30 and 31 beneath drum 16 and over a transfer corona 32, which is mounted in the usual manner beneath drum 16 to effect transfer of the toner image from the drum to the upper surface of the paper substrate. A transport 33 then conveys the toner image-bearing substrate into the image fixing subsystem of the machine.

This image fixing stage or subsystem comprises a rotating cylinder or receiver roll 40 (FIGS. 1 and 2), which is mounted in the machine to be rotated about a stationary axis beneath a radiant energy source defined by a pair of lamps 41. Roll 40 is designed to be rotated selectively at desired speeds of from about less than one rpm to about 100 rpm by an electric dipole motor 42 (FIG. 2), or the like, which has its armature drivingly connected to roll 40 as by a belt 43 (FIG. 2). The outer peripheral surface of the receiver roll 40 should have a relatively high reflectivity factor, for example, at least about 0.2 and preferably about 0.6 or higher, when the radiant energy source 41 is located externally of the receiver roll as in the illustrated embodiment; and the transmissivity of its outer peripheral surface should be less than about 0.5. This prevents undesirable heat dissipation from the outside to the inside of the roll. In the event that the radiant energy source or emitter, on the other hand, is placed within the receiver roll, the transmissivity of the receiver surface facing the radiant energy source or emitter should be relatively high, for example, at least about 0.5 and preferably about 0.6 or higher. In all cases the receiver roll should be manufactured from a material that will have satisfactory thermal stability at the operating temperature of the fixing subsystem of the copier for example, aluminum, nickel, platinum, carbon steel, stainless steel, copper and the like, sintered glass, glazed ceramic, polysulfones, glass bonded mica and the like, polyamides, glass fiber or asbestos filled phenol formaldehyde, glass filled nylons, reinforced fluroplastics, regular and filled polyphenylenes, flexible and filled silicones, etc.

The radiant energy emitters or lamps 41 should be capable of emitting light having wave lengths of from about 0.3 microns to about 10 microns. Typically these lamps may be of the iodine quartz variety, or any other capable of emitting light in the range of the above-noted wave lengths. Mounted on the machine at the side of the lamps remote from the receiver roll 40 is a reflector 45 (FIG. 1), which partially circumscribes the lamps to reflect radiant energy therefrom back toward the receiver roll 40. The reflector 45 is intended to minimize the loss of radiation to areas other than the receiver surface, and for this reason may have any configuration suitable for this purpose. The operating surface of a reflector should have a high factor of reflectivity; and it has been found that surfaces such as enamel, porcelain, aluminum, and the like may be employed for this purpose.

A bundle 46 of fiber optics comprising glass or plastic materials (FIG. 1) is mounted at one end in the reflector 45 and at its opposite end in a further reflector 48, which is mounted adjacent one of the collimating lenses 13. These fibers have highly polished ends embedded in an array in a molded plastic circumscribed by reflector 48, and function as a light pipe to convey or transmit light from the lamps 41 to the registering lens 13, thereby to provide the illumination necessary to project onto drum 16 an image of the document on platen 12. If both lenses 13 are employed, a second pipe 46' and illuminator unit 48' are employed to direct light through this second lens 13 onto the platen as shown in FIG. 1.

Preferably the fiber optic bundle 46 is conveniently assembled in a "hard-pack" arrangement, meaning that the fiber optic bundle is constructed so that cladding fills its voids. To avoid any imperfections at the illuminating end due to the discontinuities created by the cladding material, it is preferable to allow some deliberate "cross talk", which means leakage of light from one fiber to another. Typically a light pipe of the type described may comprise "Fiberscope", made by American Optical Co., and consisting of a focusing objective with a length of armored, coherent fiber image bundle connecting it to an eye piece at the other end; or a "Magnifiber" consisting of a coherent, tapered fiber bundle; or similar such products.

During use it is generally desirable to apply an additive or release agent to the outer perihery of the rotating receiver roll 40 to prevent toner from sticking to the receiver surface, and otherwise to help fix the toner to the substrate. Mounted for this purpose in the frame adjacent one side of the receiver roll 40 is a container or reservoir 50 having, for example, an arcuate applying surface that extends longitudinally of roll 40 for applying thereto a chemical additive or release agent. This additive may be in the form of certain waxes, polymers, commercial slip agents, metal salts of long chain fatty acids and/or mixtures thereof. The release agent may be dispensed in a conventional manner from the illustrated reservoir 50 onto the surface of the rotating receiver roll; or it may be applied in any suitable manner such as, for example, by a sponge, blade, wick, etc. when it is liquid form. If the release agent initially is in a solid state, it may be necessary to melt it before applying it to the roll; or it could be packed, for example, in a porous tube the pores of which are disposed in closely spaced, confronting relation to the receiver surface, so that upon the application of heat from, for example, the radiant energy emitters 41 or receiver roll 40 to the porous tube, the release agent will become molten and flow through the pores onto the surface of the rotating roll.

Rotatably mounted coaxially of each other in a stationary transport frame 52 beneath the receiver roll 40 are a plurality of axially spaced, steel discs 53. Secured around the periphery of each disc 53 coaxially thereof is a neoprene ring 54, which has rolling, very light, tangential engagement with the underside of the receiver roll 40 frictionally to be driven thereby, when the receiver roll is rotated. After transfer of a toner image on a paper substrate, or the like, the substrate is fed by transport 33, toner side up, into the nips between the rings 54 and receiver roll 40 to be advanced thereby beneath roll 40, and into the nip of the discharge transport 56. During this operation the heated surface of the roll 40 fixes the image to the substrate. However, this image fixing operation takes place, in essence, without the application of any pressure on the toner image at the time that the latter contacts the heated roll 40. The reason for this is that the rings 54 barely engage roll 40— for example, only with enough pressure to insure that a substrate passing between roll 40 and rings 54 will be gripped thereby and transported beneath the roll to its discharge side.

Mounted on frame 52 adjacent the substrate entrance and discharge sides, respectively, of the roll 40 are two sets of microswitches S1 and S2, which have operating arms positioned beneath the plane in which the paper substrate normally travels during its advance beneath roll 40.

As shown schematically in FIG. 3, switches S1 are connected in parallel with each other, and in series with a time delay relay TD1 between the power lines L1 and L2, which supply AC power to the machine when the main switch 60 is closed. Relay TD1 contrls a set of normally-open, time-delayed-closing contacts TD1-1 that are connected in series with switches S2 and the operating coil of a relay CR2 between L1 and L2. The switches S2 are connected in series with each other between switch TD1-1 and relay CR2. Relay CR2 controls normally closed contacts CR2-1, which are connected between L1 and L2 through the "forward" operating coil of motor 42, and the normally open contacts, which are connected between L1 and L2 through the "reverse" operating coil of motor 42. Another time delay relay TD2 is connected in series with CR2-2 between L1 and L2, and controls a normally open, time-delayed-closing switch TD2-1 that is in series with a power disconnect solenoid 61 between L1 and L2.

As a substrate is fed into the nip beneath roll 40 it closes switches S1 and energizes relay TD1. If the substrate emerges at the discharge side of roll 40 before contacts TD1-1 close, it will open one or both of switches S2 to prevent energization of relay CR2. If, however, a substrate jams and begins to pile up at the entrance side of roll 40, and consequently does not pass through the nip to close one of the switches S2 before contacts TD1-1 close (e.g. within a few seconds), then CR2 will be energized to open contacts CR2-1 and close contacts CR2-2 thereby to reverse the rotation of motor 42. This causes roll 40 to rotate in a reverse direction so that it tends positively to back up or unjam the loaded substrate. The closing of switch CR2-2 also energizes the time delay relay TD2, which, within a few seconds after the rotation of roll 42 has been reversed, energizes solenoid 61, which is used to operate any conventional power interrupting means (not illustrated) for the machine.

After passing beneath roll 40, a substrate may be fed by transport 56 to a conventional sorter and bin 58 in known manner. For duplication purposes the machine may also include logic controls 60 and a duplex station 61 which form no part of this invention.

To maintain the necessary image fixing temperature, a temperature controller of any desired design (not illustrated) is employed selectively to energize the emitter lamps 41, so as to maintain a desirable temperature at the nip formed between the receiver 40 and the paper transport, as defined by the neoprene rings 54. This controller includes a thermocouple (not illustrated), which is mounted adjacent the outer surface of the receiver roll 40 to detect its temperature, and to effect deenergization of lamps 41 whenever the surface temperature of the roll exceeds a predetermined value, and to reenergize the lamps when this temperature falls below a predetermined value.

Tests have indicated that, for rates of from anywhere from one to one hundred copies per minute, a toner image can be completely and satisfactorily fixed or fused upon a single pass of a substrate beneath the heated receiver roll 40. For example, a source of radiant energy comprising at least one iodine-quartz lamp and its associated reflector were mounted above a receiver roll comprising a solid aluminum cylinder having a reflectivity of about 0.6. The aluminum roll was driven by a 1-20th horsepower dipole motor having a rated torque of one foot pound. The thermocouple forming part of the temperature controller maintained the receiver surface within approximately plus or minus five degrees of 362° Fahrenheit. A thin film of a fluorcarbon lubricant dispersed in light oil, for example the type sold by Pennwalt Corporation under the trademark "Whitcon 50", was applied to the outer surface of the receiver roll; and a conventional toner comprising a copolymer of polystyrene and n-butyl methacrylate and carbon black was used in the developer. Even after continuous rotation of the receiver roll and operation of the emitter lamp for approximately one hour, the surface temperature of the receiver adjacent the nips still registered approximately 360° Fahrenheit. During this interval, when no image was being fixed the lamp was energized only about 60 percent of the time, as opposed to 90 percent when images were being fixed. Further tests indicated that, when the receiver roll was set to rotate at lower speed (fewer copies) the temperature controller could be adjusted to lower the receiver temperature required (at the nips) to effect satisfactory fixing of the toner images. Similarly, when a toner having a lower melting temperature was employed, the amount of radiant energy emitted by the lamp could be lowered through adjustment of the temperature controller without inhibiting the fixing operation.

In addition to "Whitcon 50", the following materials were found to produce excellent results when used as a release agent on roll 40: a fluoropolymer lubricant; a non-silicone aerosol spray sold by Gibralter Industries, Inc. under the trademark "Surfak"; an N, N'-ethylene bis-stearamide made by Cincinnati Milacron of New Brunswick, New Jersey; and a fatty acid ester sold by the same company under the trademark "Advawax 146".

The toner particles used with this invention usually comprise a coloring pigment or dye selected to suit a desired color of the resultant image, together with one or more thermoplastic resin binder materials for imaging polymers such as, for example, polystyrene, poly-n-butyl methacrylate, poly-i-butyl methacrylate, polyvinyl butyral, epoxy resins, amide resins, polymeric esterification products of polyols and dicarboxylic acids and/or diols and dicarboxylic acids, and the like. The coloring pigment or dye is present in the amount of approximately 7%, by weight, of the imaging polymer.

While the invention can be practiced with known toners, improved results have been achieved through the use of novel toners containing certain additives which have been found to contribute to a more satisfactory coalescence of the toner particles at even lower temperatures and power consumptions than heretofore was possible. For example, while it is known that the melting temperature of toner particles can be lowered by adding thereto certain plasticizers, this has the disadvantage that the plasticizer also lowers the blocking temperature of the toner, which is the temperature when the toner particles begin to clump or agglomerate, and therefore retards good dispensing and decreases the quality of the image fixing operation. Substantially improved results, however, have been achieved by adding both plasticizers and anti-plasticizers to high melt toner particles, or anti-plasticizers to low melt toners, thus producing desirable low melt, high blocking temperature toners.

One such class of toners comprised a polyblend of an imaging polymer with small portions of at least one plasticizer and one antiplasticizer, with the absolute difference in the values of solubility parameter S of the plasticizer with respect to the imaging polymer being less than about plus or minus 0.95 (cal/c.c.)$^{\frac{1}{2}}$, and with that of the antiplasticizer with respect to the imaging polymer being more than about plus or minus 0.95 (cal/c.c.)$^{\frac{1}{2}}$. The above-noted solubility parameter S is defined by Scatchard's Equation (Hildbrand, J. and Scott, R., The Solubility of Nonelectrolytes, 3rd edition, Reinhold, N.Y. 1950)

$$\Delta H=[S_1\text{-}S_2]^2 a_1 a_2$$

where, a = Volume fraction of each component

ΔH = Heat of mixing per c.c. of mixture

S = $(E/V)^{\frac{1}{2}}$ = Solubility Parameter, (cal/c.c.)$^{\frac{1}{2}}$

E/V = Cohesive Energy Density, cal/c.c.

E = Molar cohesive energy of each component, calories

V = Molar volume of each component

The solubility parameter of most polymers cannot be measured directly since they cannot be vaporized without decomposition. For that reason, the solubility parameters of the imaging polymers, plasticizers and antiplasticizers of this invention, have been computed from the alternative method (Small, P.A., J. Appl. Chem., 3:71, 1953) utilizing molar attraction constants.

Where $$S = \frac{\epsilon_i F_i}{V}$$

$\Sigma_i F_i$ = molar attraction constants of all the i groups making the representative molecular structure of the polymer, plasticizer or antiplasticizer.

According to the present invention, additives to the toner imaging polymer are selected for their plasticizer or antiplasticizer properties depending upon the absolute difference in their solubility parameter values; and for almost identical S, a lower or higher melting plasticizer will lead to lower or higher blocking temperature of the final toner. Moreover, either the imaging polymer or the additive should have a portion of its structure in a stiff configuration, instead of the previously held view that both the polymer and the additive should be stiff for antiplasticization to occur. Thus a toner comprising polystyrene i-butyl methacrylate (S = 9.1 (cal/c.c.)$^{178}$ ) would be, according to this invention, suitably plasticized by ethyl ethoxymethylene cyanoacetate (S = 9.6 (cal/c.c.)$^{\frac{1}{2}}$), diphenyl iso-phthalate (S = 9.06 (cal/c.c.)$^{\frac{1}{2}}$), and stearyl cyanoacetate (S = 9.8 (cal/c.c.)$^{\frac{1}{2}}$); while a toner comprising a diol/dicarboxylic acid polyester (S = 10.7 (cal/c.c.)$^{\frac{1}{2}}$) is antiplasticized by diphenyl isophthalate (S = 9.06 (cal/c.c.)$^{\frac{1}{2}}$), and cyanoacetic acid (S = 11.65 (cal/c.c.)$^{\frac{1}{2}}$). Obviously, therefore, highly desirable low melt and high blocking toners may now be obtained by selectively choosing the solubility parameter and the melting point of the plasticizer and/or the antiplasticizer.

Specific examples of such toners are as follows:

EXAMPLE 1

A toner comprising approximately 86% by weight of an imaging polymer such as a copolymer of styrene and n-butyl methacrylate; 7% by weight of an ethyl ethoxy methylene cyanoacetate plasticizer; and 7% by weight of carbon black, where S of the imaging polymer equalled about 9.1 (cal/c.c.)$^{\frac{1}{2}}$, S of plasticizer equalled about 9.6 (cal/c.c.)$^{\frac{1}{2}}$, and absolute difference / s/ equalled about 0.5 (cal/c.c.)$^{\frac{1}{2}}$. Typical particle size of toner is about 5 to 30 micron, and preferably between 9 to 15 micron. Receiver temperature 320° F. for excellent image fixing.

EXAMPLE 2

Same as Example 1 with diphenyl isophthalate (S=about 9.06 (cal/c.c.)$^{\frac{1}{2}}$) substituted for the plasticizer. Absolute difference / s/ is about 0.04 (cal/c.c.)$^{\frac{1}{2}}$. Receiver temperature 320° F. produced excellent fixing of toner image on substrate.

Another particularly desirable class of low melt toners comprising polymeric esterification products of polyols and dicarboxylic acids and/or diols and dicarboxylic acids was obtained by providing trans-esterification products of said diols and/or polyols with said dicarboxylic acids having the following general structures:

Polyol

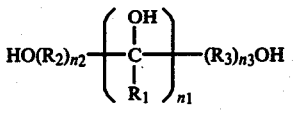

wherein $R_1$ is hydrogen and/or an alkyl, alkenyl, aryl, alkyl aryl and cycloalkyl radical of up to 8 carbon atoms.

$R_2$ and $R_3$ are alkylene, alkenylene, arylene and alkylene arylene radicals of up to 12 carbon atoms and $n_1$, $n_2$ and $n_3$ are each at least 1.

Diol

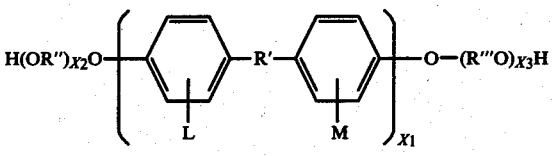

wherein

R' is chosen from a family consisting of alkylene and alkylidene radicals of up to 20 carbon atoms, arylene radical of up to 24 carbon atoms, cycloalkylidene radicals up to 16 carbon atoms and alkylene arylene radical up to 18 carbon atoms.

R'', R''' are chosen from the class consisting of alkylene radicals of at least 13 carbon atoms, alkylene arylene, arylene and cycloalkylidene radicals of at least 6 carbon atoms, L, M are selected from hydrogen, alkyl, aryl, alkyl aryl and heterocyclic radicals up to 8 carbon atoms.

$X_1$ is 0, 1, 2

$X_2X_3$ are each at least 1 and the average sum of $X_2$ and $X_3$ is 2 or greater.

Dicarboxylic Acid $$HOOC\ R^{IV}COOH$$

wherein $R^{IV}$ is chosen from the family consisting of alkylene, alkenylene, arylene and alkylene arylene radicals of up to 24 carbon atoms.

Any conventional process for synthesizing the trans-esterification product may be employed. Whenever polyols are used, they are kept at a very minor proportion, as for example about less than 5 percent and preferably about 1 percent of the weight of the diol used. This is to insure that excessive cross linking does not occur, thus defeating the purpose of the low melt features of the imaging polymer. Also, best results are obtained by keeping close control of the polymerization and not allowing the system to gel, which may be easily achieved by those skilled in the art. Typically, temperature is kept at 200° to 225° C. and time, 10 to 11 hours. Inert atmosphere is provided to facilitate reaction. (Toward the end of 8 hours a vacuum is applied, thereby reducing the pressure in the flask to about 20 mm. The resulting product is generally light yellow to amber in color.)

Contrary to known rapid melting linear polyester products, a minor amount of the cross linked esterification product in the above-noted class of toners designed as an in-situ, self-plasticizing or self-antiplasticizing component provides wider melting and viscosity latitude to the linear polyester. This leads to much more desirable imaging polymers since the solubility parameter of the cross linked product could be predetermined and tailored with respect to the linear polyester appropriately to render it a plasticizer or antiplasticizer.

Examples of toners incorporating the above-noted polyester complexes are:

EXAMPLE 3

A toner comprising about 92% of a complex esterification product of equimolar proportions of adipic acid and a diol adduct comprising two parts styrene oxide and one part bis phenol A and a trace of glycerol and sorbitol and about 8%, by weight, of carbon black, where bis phenol A is 2,2'-bis-(4 hydroxy phenyl) propane. This complex esterification thus contains a minor amount of partially cross linked product comprising glycerol and sorbitol; and this cross linked product acts as an in-situ plasticizer affording the linear esterification product a wider thermal and rheological latitude. This latitude contributes to the controlled viscosity of the molten toner when it becomes fixed to the substrate upon contacting roll 40, thereby preventing any undesirable hot offsetting. Receiver roll temperature of 300° F. resulted in excellent image fixing.

EXAMPLE 4

Same as Example 3 except that the imaging polymer was the esterification product of ethylene oxide, bis phenol A, terephthalic acid and a trace of glycerol. Good results at receiver temperature of 270° F. Hot offsetting, however, appeared at receiver temperature of 330° F.

EXAMPLE 5

Toner was produced from imaging polymer similar to Example 4, which contained an in situ plasticizer and had computed S value of about 10.7 (cal/c.c.)$^{\frac{1}{2}}$, by blending with the polymer about 15% by weight of diphenyl isophthalate of S value of about 9.06 (cal/c.c.)$^{\frac{1}{2}}$, and about 8% carbon black. Fixing step occurred without any hot offsetting at 330° F. receiver temperature. With the absolute difference / s/ in this example equalling about 1.64 (cal/c.c.)$^{\frac{1}{2}}$, the additive diphenyl isophthalate now acts as antiplasticizer, as compared to its plasticizing function in Example 2.

It has been found that the fixing operation of this invention can be further enhanced by the use of novel developers comprising, essentially, a carrier, electrostatographic toner particles, and at least one additive to enhance various stages of the image development, transfer and fixing. The typical developer of this invention employs about 1 part of an additive or about 1 part each of several additives, about 10 to about 200 parts by weight of toner, and about 100 to about 10,000 parts by weight of carrier in the electrostatographic development step. Certain of such additives may be added to the developer to enhance the xerographic transfer of an image, while another of the additives could be contributing to improved cleaning of the reusable photoconductor often used in known systems to produce a latent image, and/or to help fix the image on a substrate at lower temperature or power levels than are required when no such additives are employed.

Examples of these novel developers are as follows:

EXAMPLE 6

A developer comprising, a carrier and a composite toner containing an imaging polymer such as a copolymer of polystyrene and n-butyl methacrylate, a colorant such as carbon black, and about 1% by weight (toner weight) of an external, barium oxide/silicate additive such as sold by National Lead under the trademark "Barosil".

EXAMPLE 7

A developer as in Example 6 where the external additives comprised about 1% by weight of "Barosil" and about 0.2% by weight of terephthalic acid.

EXAMPLE 8

A developer as in Example 6 where the external additives comprises, by weight, 1% "Barosil", 0.1% cadmium stearate, and 0.2% terephthalic acid.

EXAMPLE 9

A developer as in Example 6 where the additive comprised, by weight, 1% of a compound sold by Argus Chemical under the trademark "mark 1306B", 0.2% terephthalic acid, and 0.2% cadmium stearate.

Instead of mixing an additive with the developer to enhance, for example, the fixing of a toner image, it is possible to apply the additive to the substrate. Improved fixing has been realized, for example, by using a known developer to produce a toner image on a paper substrate, the surface of which had been coated or treated with ethylethoxymethylene cyanoacetate. Where practical, therefore, additives of the type described could be introduced in the copying process at different stages, rather than be mixed together in the developer.

Conventional developers employ relatively large carrier particles to which finely divided toner particles cling electrostatically. When the developer is applied to an electrostatic, latent image that has been produced, for example, on a reusable photoconductive surface, the toner particles are transferred from the carrier particles to the latent image for a subsequent transfer to a paper substrate, or the like. It has been customary heretofore to manufacture such carrier particles either from non-magnetic material such as sand, glass, ceramic beads, etc., or from magnetic material such as sand, glass, ceramic beads, etc., or from magnetic material such as, for example, steel alloys, etc. Typically the magnetic carriers are heavier than the non-magnetic ones, due mainly to the higher density of the magnetic carriers. To date, while most known carriers have tailored surface electrical properties, other desirable features such as low density magnetic, high abrasion and/or temperature-resistant, variable density non-magnetic and magnetic properties have not been achieved.

The variation of density of the final carrier falling in either group of core materials (magnetic or non-magnetic), has been achieved by providing a coating on the core materials, the coating, comprising a resin binder and hollow glass spheres and/or phenolic balloons. The resin binder, besides controlling the triboelectric charge of the carrier surface, helps the low density spheres or balloons to adhere to the core materials, thus leading to carriers having variable density depending upon the per cent of spheres or balloons used. The above coatings may be applied to the carrier cores by known processes involving e.g., solvent, slurry or moderate impaction techniques with or without forced curing. Alternatively, the coatings may be applied in a novel manner by electrostatic coating of the resinous composite to provide the final electrostatographic carriers.

In the electrostatic coating process, resin particles, such as polyvinyl chloride, polytetrafluoroethylene, acrylic and epoxy resins of about 20 to about 80 micron, are conveyed by compressed air to a spray gun, which contains a high-voltage, low-amperage electrical source. The resin particles pick up the charge and are then blown against a batch of grounded core material to be coated. Because of the difference in electrical potential between the resin and the core material, the particles of resin are attracted to said core material, where said particles compact into a tight layer around each core. They continue to adhere to the core material until the ensemble is conveyed to an oven where the resin is fused into a coating. The above disclosed electrostatic coating technique to make novel electrostatographic carrier is superior to the methods employed in the prior art, as for example any method using solvents. With this electro-static process it is possible to obtain coatings of less than 2 mils thickness as well as much thicker coatings, if desired, by preheating the core material. Besides the technical flexibility, the electrostatic coating technique provides additional controls in environmental pollution problems; electrostatic powders are much more easily and satisfactorily controlled than the objectionable solvent vapors, which in addition, often stays occluded in the carrier coatings made in the prior art and leads to early developer failure.

The much desired high abrasion and/or high temperature resistance of the carrier is achieved in one embodiment of this invention, by a gas phase reaction of the type as shown below;

$$2Ta + 5Cl_2 \rightarrow 2\ TaCl_5$$

$$2TaCl_5 + 5H_2 \rightarrow 2Ta + 10HCl$$

wherein tantalum (metallic) is reacted with a halogen gas to form the metal halide. The halide is then mixed with hydrogen and pumped into a reaction chamber containing the core material (for instance steel shot) that is to be coated. The chamber is heated to vaporize and deposit it on the steel shot core materials. Tungsten, molybdenum, columbium, titanium carbide, titanium nitride, zirconium, nickel, silicon, silicon carbide and silicon nitride coatings can also be applied by this process to substrates such as glass, ceramics, aluminum, graphite, and steel.

The variation of triboelectric charge in any carrier/toner combination is conveniently achieved by choosing the materials of a carrier coating and the imaging polymer of the toner from a suitable triboelectric series. A typical particle diameter between about 50 microns to about 3000 microns is desirable because the carrier particles then possess sufficient mass and inertia to avoid adherence to the electrostatic images during the development process.

Prior photoconductors of the high performance variety have generally been produced by cladding a thin layer of a photoconductive material, such as selenium, or an alloy thereof, to a substrate such as aluminum, or the like. Typically selenium and arsenic in molten states are mixed together to form a selenium/arsenic alloy, which is then deposited on the aluminum substrate by conventional vacuum evaporation techniques. A major disadvantage of this type of photoconductor is that, in contrast to pure vitreous selenium, the selenium/arsenic alloy, despite its superior spectral sensitivity and thermal stability to the former, becomes extremely brittle upon being deposited on the substrate, and tends to develop stress cracks, which reduce the overall life of the photoconductor, or require the addition of dopants thereto, thus making it more difficult and expensive to produce. It has been found that the undesirable brittleness of a photoconductor of this type can be obviated by applying or cladding the selenium element to the substrate first, and then diffusing the arsenic into the already deposited selenium. This method is called metalliding, and is achieved by a high-temperature electrolytic process in which the diffusing metal (for example arsenic), which serves as an anode, is suspended together with the receptor metal (for example selenium), which serves as a cathode, in a bath of molten fluoride salt that is maintained at a temperature between 400° to 1350° centigrade. A direct current is then passed from the anode to the cathode, and the anode material dissolves and is transported to, and is diffused into, the cathode, giving rise, in the example in consideration, to a selenium/arsenic alloyed surface substantially less brittle than heretofore possible.

The solvent in the above-noted metalliding process is an alkali and/or alkaline earth metal fluoride. These fluorides combine with the fluorides of other metals to produce soluble and likely stable fluometallate anions (negative ions). Hence the "-iding" agents dissolve in the molten fluorides whether those agents are a solid with a high melting point or a gas. Usually, only a small amount (less than about 1%) of the "iding" fluoride needs to be dissolved in the solvent fluoride for the metalliding reaction to take place. Metalliding reactions can be carried out even by going against electromotive series, which is not possible in conventional electrolysis, thus enabling the arseniding, antimoniding, germaniding, and the like of the photoconductive selenium, if desired.

To obtain a ternary or quarternary alloyed surface, it is necessary to carry out more than one metalliding operation. Thus by employing these techniques unique photoconductors of tailored composite and chemical composition, which heretofore could not be clad satisfactorily on to a substrate, are now possible.

The composite photoconductors of the type employing binder materials are known to those skilled in the art. Such composite photoconductors are either inorganic photoconductors, organic photoconductors and/or mixtures thereof in layered structural shapes or in fine particulate forms. In all such cases, the binder materials are responsible for providing good mechanical integral state and form, desirable thermal, rheological, abrasion and hardness attributes and compatible electrical properties with the photoconductor material itself. Thus the binder materials have to be tailored to meet the above stated performance requirements.

One of the major problems known in the composite photoconductor field is the lack of good control over the electrical properties. While there are many photoconductors and many binder materials available to date, those skilled in the art have found that the space charge limitations of a photoreceptor system lead to special design constraints. Vitreous photoconductors, organic photoconductors and the like with highly desirable semiconducting properties often could not retain the same when made into a composite photoconductor. The problem is more acute and obvious, when organic photoconductors are used and a binder material is invariably needed.

Solutions to the above-stated space charge problems are found by providing a new general class of chemical compounds with semiconducting properties as the binder material, which also provides desirable photoelectric properties and colors if necessary and tailored to do so. This generic class of chemical compounds comprises the polymers, copolymers, synthetic organics, organometallics and chemicl complexes of tetracyanoethylene. The highly functional structure, very strong Lewis acid properties, ability to form $\pi$-complexes, and its strong reactivity as a dienophile for the Diels Alder type reactions, render these tetracyanoethylene compounds highly useful in making not only the above composite photoconductors, but also colored toners, photoconducting toners and disposable photoconductors clad on paper or other substrates.

Polymers and copolymers of tetracyanoethylene with styrene, ethylene, acrylonitrile and the like, chelated metal polymers and complexes with photoelectric and/or semiconducting properties, tricyanovinyl compounds made by reactions with tert-aryl amines and the in-vivo dye substituted, (highly colored) polymers of tetracyanoethylene are included, but not limited to, among the above disclosed chemical compounds of tetracyanoethylene.

From the foregoing it will be apparent that the instant invention permits substantial reduction in power requirements per copy for copying machines using electroscopic toners of the type described. The use of a radiant energy emitter, in combination with a transport which conveys a toner image into substantially pressureless contact with a heated fixing roll, obviates much of the power heretofore wasted in machines of the type in which the fixing roll was heated inductively or convectionally, or in which both heat and pressure were employed in the fixing operation to improve coalescence of the toner particles. As previously noted, toners of the type described comprise a very high proportion by weight of polymeric resins, the glass transition temperatures of which are raised by the application of pressure, so that in effect, fixing processes which rely upon heat and pressure are partially self-defeating. For this reason the neoprene rings that transport the toner-coated substrate beneath the receiving roll 40 of this invention, are barely in contact with this roll, so that they do not apply any significant pressure to the substrates advanced thereby beneath the roll during the fixed operation.

Further improvements in the fixing of toner images are afforded through the use of the herein disclosed novel developers containing improved polyester toners, and/or improved carriers, together with additives which are designed to improve image transfer, cleaning and fixing, etc. These additives include plasticizers and antiplasticizers for decreasing and increasing, respectively, the glass transition temperature of the toner particles and produce desirable high block, low melting toners. Additives to the surface of the fixing roller 40 also improve the quality of the fixed images on the copy substrates.

While excellent carrier particles may be produced by the above-noted electrostatic process in which the charged resin particles are sprayed in cloud form onto grounded core material, it is possible also to produce such carriers by forming a fluidized bed from the charged resin particles, and then feeding the grounded core particles through the fluidized bed, for example by rolling the core particles down a grounded chute that is inclined to the bed. The coated core particles could then be rolled or otherwise transported through an oven to fuse thereon the surrounding resin particles.

Having thus described my invention, what I claim is:

1. A low melt toner comprising a colorant and a polyblend of an imaging polymer and an antiplasticizer, with the absolute difference in the solubility parameter of the antiplasticizer with respect to the imaging polymer being more than about ±0.95 (cal/c.c.)$^{\frac{1}{2}}$ where said solubility parameter is defined by $$\Delta H = \left[\left(\frac{E_1}{V_1}\right)^{\frac{1}{2}} - \left(\frac{E_2}{V_2}\right)^{\frac{1}{2}}\right]^2 a_1 a_2$$

$$= [S_1 - S_2]^2 a_1 a_2$$

where $\Delta H$ = heat of mixing per c.c. of mixture $S = (E/V)^{\frac{1}{2}}$ = solubility parameter, (cal/c.c.)$^{\frac{1}{2}}$ $$= \frac{\Sigma_i F_i}{V}$$

$F_i$ = Molar attraction constant of group $i$ $\Sigma_i$ = summation $i$ over all groups $\frac{E}{V}$ = cohesive energy density, cal/c.c.

$E$ = molar cohesive energy

-continued $V$ = molar volume of each component $a$ = volume fraction of each component

2. A toner as defined in claim 1, wherein said imaging polymer is a polymeric esterification product of dicarboxylic acid, a diol, and a polyol.

3. A high melt toner comprising a colorant and a polyblend of an imaging polymer including a plasticizer and an antiplasticizer, with the absolute difference in the solubility parameter of the antiplasticizer with respect to the imaging polymer being more than about 0.95(cal/c.c.)$^{\frac{1}{2}}$ where said solubility parameter is defined by $$\Delta H = \left[\left(\frac{E_1}{V_1}\right)^{\frac{1}{2}} - \left(\frac{E_2}{V_2}\right)^{\frac{1}{2}}\right]^2 a_1 a_2$$

$$= [S_1 - S_2]^2 a_1 a_2$$

where $AH$ = heat of mixing per c.c. of mixture $S = \left(\frac{E}{V}\right)^{\frac{1}{2}}$ = solubility parameter, (cal/c.c.)$^{\frac{1}{2}}$ $$= \frac{\sum_i Fi}{V}$$

$Fi$ = Molar attraction constant of group $i$ $\Sigma i$ = summation $i$ over all groups $\frac{E}{V}$ = cohesive energy density, cal/c.c.

$E$ = molar cohesive energy $V$ = molar volume of each component $a$ = volume fraction of each component including a plasticizer, with the absolute difference in the solubility parameter of the plasticizer with respect to the imaging polymer being less than about 0.95 (cal/c.c.).

4. A toner as defined in claim 3, wherein said imaging polymer comprises 77% by weight of an esterification product of ethylene oxide bis phenol A, terephthalic acid and a trace of glycerol, and containing an in-situ plasticizer and having an S of about 10.7 (cal/c.c.)$^{\frac{1}{2}}$, and said antiplasticizer comprises 15% by weight of diphenyl isophthalate having an S of about 9.06 (cal/c.c.)$^{\frac{1}{2}}$.

* * * * *